United States Patent [19]

Fernandes

[11] 4,012,040

[45] Mar. 15, 1977

[54] MAGNETIC HOCKEY GAME

[76] Inventor: Gilbert Fernandes, 238 Robert St., Westport, Mass. 02790

[22] Filed: May 17, 1976

[21] Appl. No.: 686,785

[52] U.S. Cl. ..... 273/85 A; 273/85 F

[51] Int. Cl.[2] ..... A63F 7/06; A63F 7/10

[58] Field of Search ..... 273/85 A, 85 B, 85 F

[56] References Cited

UNITED STATES PATENTS

| | | | |
|---|---|---|---|
| 2,507,258 | 5/1950 | Kohler | 273/85 B |
| 2,716,028 | 8/1955 | Yaeger | 273/85 B |
| 2,819,082 | 1/1958 | Peters | 273/85 A |
| 3,214,171 | 10/1965 | Luchsinger | 273/85 F |
| 3,466,042 | 9/1969 | Lucci | 273/85 A |
| 3,810,622 | 5/1974 | Payne, Jr. | 273/85 A |
| 3,912,269 | 10/1975 | Barlow | 273/85 B |

FOREIGN PATENTS OR APPLICATIONS

| | | | |
|---|---|---|---|
| 632,798 | 12/1961 | Canada | 273/85 B |
| 513,568 | 2/1955 | Italy | 273/85 A |
| 210,853 | 8/1940 | Switzerland | 273/85 A |

*Primary Examiner*—Paul E. Shapiro
*Attorney, Agent, or Firm*—William Nitkin

[57] ABSTRACT

An improved magnetic hockey game having player pieces manipulated by magnets under a playing board surface and in which the goalie player pieces are controlled by the lateral movement of the forward player piece's controlling arm members.

12 Claims, 5 Drawing Figures

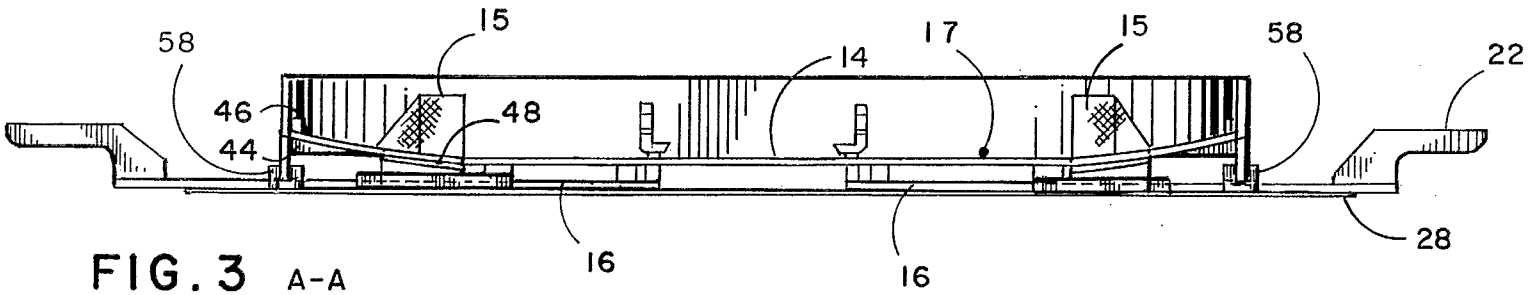
FIG. 3 A-A
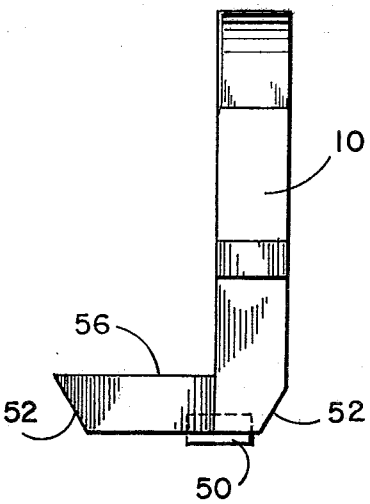
FIG. 5
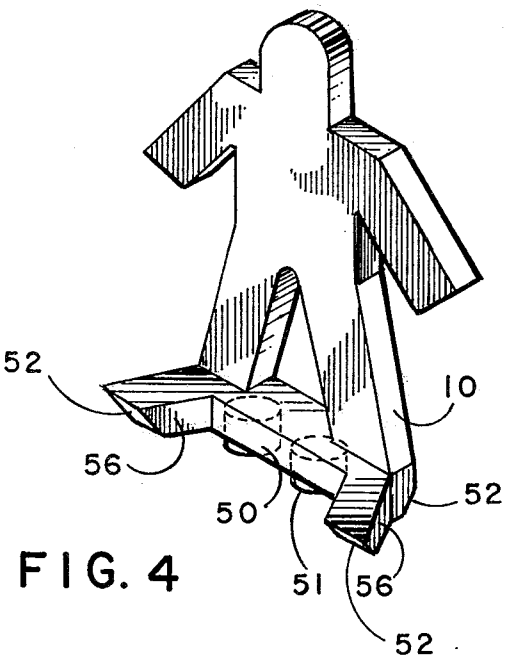
FIG. 4

MAGNETIC HOCKEY GAME

BACKGROUND OF THE INVENTION

1. Field of the Invention

This invention relates to a manually-operated magnetic game apparatus simulating ice hockey play.

2. Description of the Prior Art

There have been many manually-operated ice hockey games employing magnetism developed over the years. On several of these games U.S. patents have issued. The control of player-pieces from below the game board's surface by movable magnetic members is disclosed in the following U.S. Pat. Nos. 2,263,115; 3,698,716; 3,823,941; 3,091,459; 3,782,726; and 2,716,028. U.S. Pat. No. 2,716,028 illustrates a magnetic ice hockey game similar in appearance to the device of this invention in which two hockey player-pieces per side are each manipulated by movable arm members extending under the playing surface and one goalie player-piece per side manipulated by a third movable arm member extending between the first two hockey player-pieces' movable arm members. These three movable arm members allow for the movement of the player-pieces across the surface of the playing board. These player-pieces can be further rotated by the manipulation of control members associated with the movable arm members as a player-piece is being moved along the surface of the game board. The device of this invention, while somewhat similar in appearance to the aforementioned games, embodies many new and novel improvements in both construction and design which are set out below.

SUMMARY

The apparatus of this invention is a manually-operated magnetic ice hockey game incorporating a playing surface similar in design to an ice hockey rink on which two forward and one goalie player-pieces per side, having magnets affixed to their bases, are arranged. The two forward player-pieces and goalie player-piece are each controlled by arm members also having magnets located below the surface of the game board. Each of the forward player-pieces has a range of movement from its goal to the mid-line of the playing board. A goalie player-piece is positioned in front of each goal and has a semi-circular range of movement in front of its goal. The mechanism of its movement differs substantially from the mechanism of movement of the goalie player-pieces disclosed in the prior art. In the device of this invention the manipulation of each goalie player-piece is governed by the sidewards manipulation of the two movable arm members which also control the forward player-pieces. A detailed description of the manipulation and controlling mechanism of the goalie player-pieces follows in the Description of the Preferred Embodiment. The device of this invention further differs from the prior art in having a slight bank along each end of the playing surface so that the puck member can easily get back into play when hit to the side of, or behind, the goal net. The device of this invention further differs from the prior art in having vertical cushioning means around the perimeter of the playing surface to assist in the rebounding of shots between the player-pieces. Each player-piece in the device of this invention is constructed of a foam material and has two magnets mounted at its base, each magnet having a different polarity facing downward. It has been found that the utilization of foam player-pieces having beveled bases makes each player-piece self-righting should it be knocked down. The player-pieces' arm members also have two magnets of opposing polarity to the polarity of the magnets of its associated player-piece facing upwards the same distance apart as the distance between the two magnets on its associated player-piece in such a manner that the player-piece is attracted to its associated arm member when placed in a forward-facing position; and repelled by its associated arm member when placed in a non-forward-facing position.

The object of the game of this apparatus is similar to the object of real ice hockey which is to score points by getting the puck member into the opposite goal. Unlike real ice hockey, each player-piece can travel only over its own half of the playing board surface. It is anticipated that standard ice hockey rink markings can be placed on the playing surface. A puck member in the form of a small ball as disclosed in some of the prior art is also utilized in the device of this invention.

The easy manipulation of the self-righting forward player-pieces in conjunction with the novel operation of the self-righting goalie player-pieces and other improved features of the device of this invention make this invention more commercially feasible and more enjoyable to play than other apparatus disclosed in the prior art.

BRIEF DESCRIPTION OF THE DRAWINGS

FIG. 3 is a cutaway view through section A—A of FIG. 1 illustrating the banked contours of the playing board surface.

FIG. 4 is a perspective view of a self-righting player-piece utilized in the device of this invention.

FIG. 5 is a side view of a self-righting player-piece utilized in the device of this invention.

DESCRIPTION OF THE PREFERRED EMBODIMENT

Figure 1:
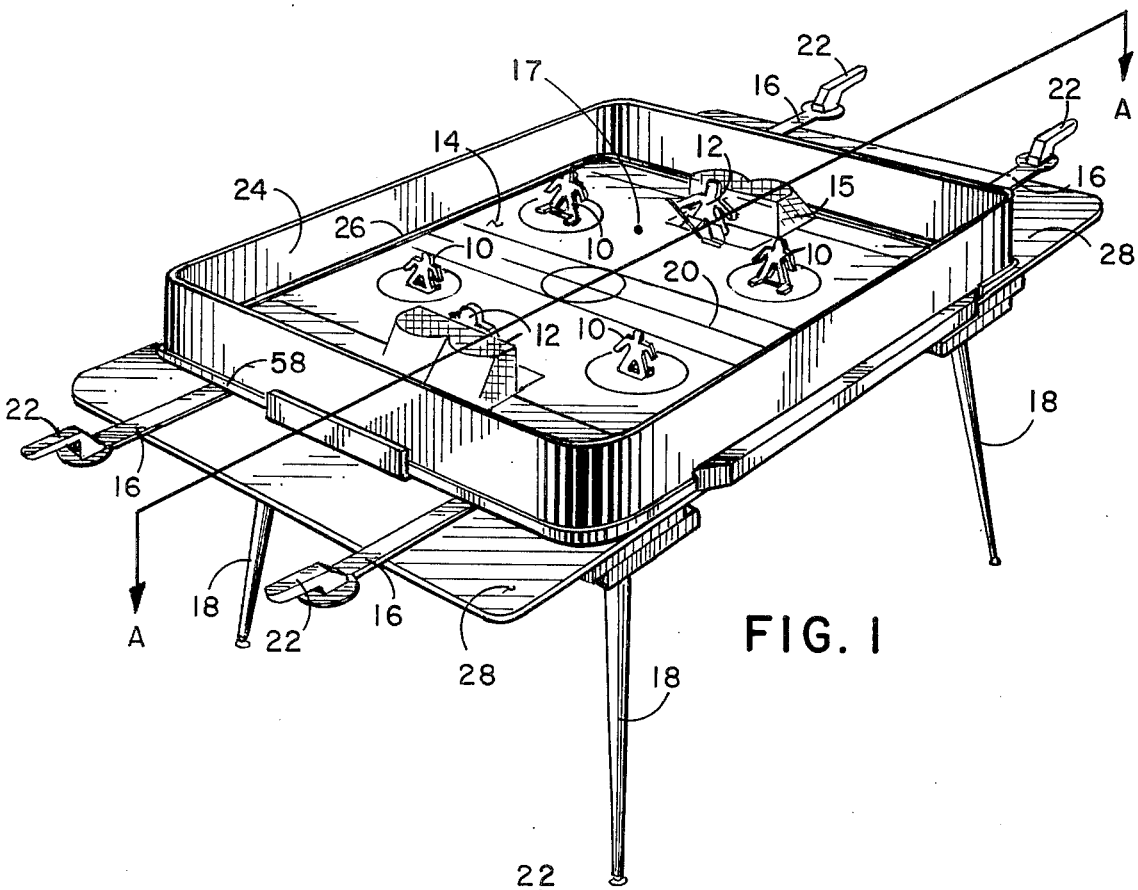
FIG. 1 is a perspective view of the device of this invention.

FIG. 1 illustrates a perspective view of the device of this invention showing two forward player-pieces 10 and goalie player-piece 12 in position facing midline 20 on each side of playing board surface 14 with movable arm members 16 extending out from under the playing board surface 14 at each end. The device of this invention can be either mounted on legs 18 as illustrated in FIG. 1 or the legs can be unscrewed and the game rested on a table. The playing board surface 14 is illustrated as having imprinted thereon standard ice hockey rink markings including midline 20. Other desired markings can also be utilized. Also illustrated at one end movable arm member are movable arm member handles 22. The shape of these handles is such that when the handles strike resilient cushioning 58, the termini of movable arm members 16 beneath the surface of the playing board reach midline 20 of the playing board. Elevated rink border 24 surrounds the playing board surface 14 and mounted along the inside of elevated rink border 24 at its junction with the playing board surface is resilient cushioning 26 which can be composed of expanded foam or equivalent material which is utilized to soften the rebounds of puck member 17 to allow rebound plays off the elevated rink border. Resilient cushioning 26 also acts to slow down the puck member so that it can be more easily controlled by the player for accuracy of shots and passes. Resilient cushioning 58 which is mounted along the outer perimeter of elevated rink border 24 can also be composed of expanded foam or equivalent material and serves to cushion the striking of handles 22 of movable arm members 16 against elevated rink border 24. Extending from the ends of the game board and acting as a base upon which movable arm members 16 rest and slide is base member 28. This base member extends under playing board surface 14 and can have mounting means for attachment of removable legs 18 on its bottom for the support of the game board. Folding legs or equivalent support means can also be utilized. It has been found that a four-ply cardboard or equivalent is suitable for the composition of playing board surface 14 and that Lexan plastic material or equivalent material can be used to construct movable arm members 16.

Figure 2:
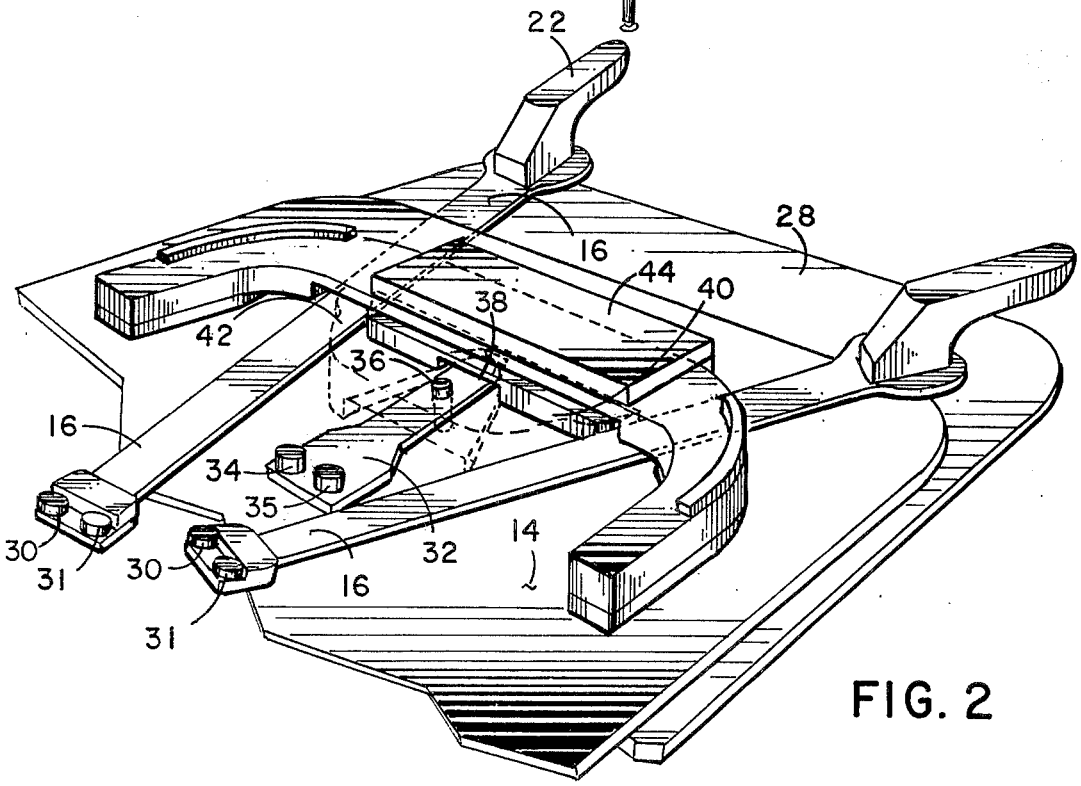
FIG. 2 is a cutaway view of FIG. 1 illustrating the controlling mechanism of the goalie player-piece.

FIG. 2 is a cutaway view of FIG. 1 illustrating the controlling mechanism of the goalie player-piece and illustrating movable arm members 16 which each control the movement of its associated forward player-piece. Movable arm members 16, composed of Lexan plastic or equivalent flexible material, can be manipulated even when bent upwards or downwards depending upon the height of the player. Each movable arm member has at its terminus below the playing board surface first arm member magnet 30 and second arm member magnet 31, the first arm member magnet having its positive pole facing upwards and the second arm member magnet having its negative pole facing upwards. First arm member magnet 30 and second arm member magnet 31 are spaced the same distance apart as the distance between first player-piece magnet 50 and second player-piece magnet 51 illustrated in FIG. 4 wherein first player-piece magnet 50 has its negative pole facing downward and second player-piece magnet 51 has its positive pole facing downward. When movable arm member 16 is passed below its associated forward player-piece, the player-piece automatically assumes a forward facing position due to the effect of magnetic attraction which allows movable arm member 16 to control the movement of its associated forward player-piece. Base member 28 upon which the movable arm members slide can be waxed or have an equivalent low friction coating thereon to facilitate sliding of the movable arm members in accordance with the speed of the game's operation. The controlling mechanism of the goalie player-piece functions as follows. Goalie arm member 32 has mounted at one end first goalie arm member magnet 34 and second goalie arm member magnet 35, first goalie arm member magnet having its positive pole facing upwards and second goalie arm member magnet havving its negative pole facing upwards. First goalie arm member magnet and second goalie arm member magnet are spaced the same distance apart as the distance between the first and second magnets affixed to their associated goalie player-piece wherein first goalie player-piece magnet has its negative pole facing downward and the second goalie player-piece magnet has its positive pole facing downward. When goalie arm member 32 is passed beneath its associated goalied player-piece, the goalie player piece automatically assumes a forward-facing position due to the effect of magnetic attraction which allows goalie arm member 32 to control the movement of its associated goalie player-piece. Goalie arm member 32 pivots on goalie arm member pivot 36. At its other end goalie arm member 32 is inserted into guide member slot 38 of laterally movable guide member 40. Guide member 40 is held in place by guide restraining member 42 and is manipulated laterally by contact with movable arm members 16 so that a player can control the positioning of the goalie player-piece in front of its goal by a lateral movement of movable arm member 16. Thus, if it is desired to have the goalie player-piece move to the right, the righthand movable arm member is slid laterally toward the left. If it is desired to have the goalie player-piece move toward the left, the lefthand movable arm member is slid laterally toward the right. It has been found that after practice a player can manipulate his forward player-pieces to any desired position on his side of the playing board and can, at the same time, manipulate the goalie player-piece by a lateral movement of the desired movable arm member. The improved goalie controlling mechanism allows the entire game to be operated by players having one hand on the handle 22 of each movable arm member at their end of the playing board and these players do not have to release the handles of the movable arm members in order to manipulate the goalie player-pieces. Also seen in FIG. 2 is banked support member 44 which supports the bank's contour at the end of the playing board and which support member can be constructed of foam or other resilient material. When in position, support member 44 causes the game board to be elevated at the rear and, to a somewhat lesser degree, sides of goals 15 illustrated in FIG. 1 so that the puck member will always roll back into play should it be hit behind a player-piece or behind goals 15.

Seen in FIG. 3 is a cutaway view through section A—A of FIG. 1 and illustrates banked contour 46 of the rear of the playing board surface 14 behind goals 15. The banked contour is contoured just enough to prevent puck member 17 from remaining behind the goal net. The speed of the game can thus be maintained by not having a player stop to retrieve the puck member from an inaccessible place on the playing board. In the device of this invention the puck member is always in play on the playing board unless a goal has been scored. A further improvement in the device of this invention over the prior art is that the area within each goal is depressed and in one embodiment can be inclined downward in the direction of the midline of the playing board surface so that the puck member will roll toward the opening of the goal for easy retrieval by a player and will remain in the goal as it cannot rise above the lip of the front of the goal's inner depression 48. This depression feature also assists in keeping track of the scoring of goals which would be difficult if the puck member quickly went in and out of the goal.

FIG. 4 is a perspective view and FIG. 5 is a side view of a typical self-righting player-piece utilized in the device of this invention. Player-piece 10 can be constructed of a foam material or equivalent light material such that its center of gravity is always at its lowest point. Shown are first player-piece magnet 50 and second player-piece magnet 51 affixed to the player-piece's bottom. It has been found that beveled edges 52 at the lower front and lower rear of the player-piece assist in the player-piece's self-righting ability. Projections 56 at the base of the player-piece take the place of a hockey stick and assist in controlling the direction of the puck member while the game is played. The combination of foam construction, magnets attached to the bottom of the player-piece, and beveling of the lower front and rear portions of the base of the player-piece allow each player-piece to right itself should it be knocked over.

In a further embodiment of the device of this invention a scoring mechanism can be located over the device similar in appearance to the type found within large professional hockey rinks. Also the depressed goal area can have within it electronic circuitry to detect when the puck member has entered the goal. A microswitch can be located under a slightly movable surface sensitive to the weight of the puck member. Should the puck member go into the goal, the microswitch would be triggered and a light could go on to signify that a goal had been scored. A buzzer could also be sounded and have the same effect as in a real game. It is further anticipated that the player-pieces can have different uniform designs similar in appearance to professional team uniforms and that a player's box can be affixed to the edge of the game board to contain a plurality of player-pieces of different professional teams. It is anticipated that the device of this invention can be played by more than two players, one player each controlling one of the four handles of the movable arm members.

Although the present invention has been described with reference to particular embodiments, it will be apparent to those skilled in the art that variations and modifications can be substituted therefor without departing from the principles and spirit of the invention.

I claim:

1. A manually-operated magnetic game having forward player-pieces and goalie player-pieces having magnets affixed to their bases arranged upon a playing board surface, said player-pieces movable by magnets located under said playing board surface, said game comprising:

a plurality of movable arm members having said magnets located under said playing board surface mounted at one end, each of said movable arm members being associated with one of said forward player-pieces;

a base member located below said playing board surface upon which said movable arm members are slideably positioned;

an arm member handle affixed to the other end of each of said movable arm members;

an elevated rink border affixed to the perimeter of said playing board surface;

a goalie arm member located beneath said playing board surface and resting upon said base member and having an aperture defined therein;

a goalie arm member magnet affixed at one end of said goalie arm member;

a goalie arm member pivot affixed to said base member and extending into said aperture within said goalie arm member;

a guide restraining member positioned above said goalie arm member having a recess defined therein to allow pivotal movement of said goalie arm member upon said goalie arm member pivot; and a guide member laterally slideably positioned under said guide restraining member having a guide member slot defined therein arranged to engage the other end of said goalie arm member so that lateral force applied by a movable arm member against said guide member causes said goalie arm member to pivot causing said goalie arm member's associated goalie player-piece located on said playing board surface to move in front of its goal.

2. A device as recited in claim 1 wherein said playing board surface is banked at each end.

3. A device as recited in claim 2 further including resilient cushioning affixed to the inner lower portion of said elevated rink border at the junction of said elevated rink border and said playing board surface.

4. A device as recited in claim 3 further including resilient cushioning affixed to the outer lower end portions of said elevated rink border.

5. A device as recited in claim 3 wherein the area within the goals is depressed below the surface of said game board.

6. A device as recited in claim 5 wherein the base of said goal depression is at an inclined plane angled downward in the direction of the midline of said playing board surface.

7. A device as recited in claim 3 wherein said magnets affixed to said player-pieces are each comprised of a first and a second player-piece magnet, said first player-piece magnet having its negative pole facing downward and said second player-piece magnet having its positive pole facing downward.

8. A device as recited in claim 7 wherein said magnet affixed to each of said movable arm members and said goalie arm members is comprised of a first and a second arm member magnet, said first arm member magnet having its positive pole facing upward and said arm member magnet having its negative pole facing upward; said first and second arm member magnets being spaced apart from one another in coincidental relationship with the first and second player-piece magnets of their associated player-pieces wherein said first player-piece magnet is magnetically attracted to its associated first arm member magnet and said second player-piece magnet is magnetically attracted to its associated second arm member magnet.

9. A device as recited in claim 3 wherein said forward player-pieces and said goalie player-piece are constructed of foam-like material.

10. A device as recited in claim 9 wherein the lower front and rear portions of said player-pieces are beveled.

11. A device as recited in claim 3 wherein said movable arm members are flat and vertically flexible.

12. A device as recited in claim 11 wherein said base member has a slippery surface on which said movable arm members easily slide.

* * * * *